US006039146A

United States Patent [19]

Byun et al.

[11] Patent Number: 6,039,146

[45] Date of Patent: Mar. 21, 2000

[54] METHOD OF MANUFACTURING SPEAKER DIAPHRAGM

[75] Inventors: Hong J Byun; Jun W Lim; Hwi C Park, all of Yangsan, Rep. of Korea

[73] Assignee: LG Foster Ltd., Yangsan, Rep. of Korea

[21] Appl. No.: 09/187,417

[22] Filed: Nov. 6, 1998

[30] Foreign Application Priority Data

Nov. 6, 1997 [KR] Rep. of Korea ..... 97-58341

[51] Int. Cl.[7] ..... H04R 7/00

[52] U.S. Cl. ..... 181/169; 181/172; 181/173

[58] Field of Search ..... 181/164, 165, 181/167, 169, 170, 173, 174, 172

[56] References Cited

U.S. PATENT DOCUMENTS 2,624,417 1/1953 Brennan ..... 181/169

5,619,019 4/1997 Yoshimura et al. ..... 181/166

*Primary Examiner*—Khanh Dang

*Attorney, Agent, or Firm*—Pillsbury Madison & Sutro LLP

[57] ABSTRACT

A method for manufacturing a speaker diaphragm comprising the steps of forming a plurality of virtual concentric circles between central point of a circle having a predetermined size and a circumference thereof; dividing said each concentric circle with a predetermined angle, forming divided points on the circumference of each concentric circle and arranging a plurality of yarns from a point on the circumference of said circle to another point thereof to come in tangential contact with said divided points, thereby forming a omnidirectional pseudo-textile fabric; thermosetting said pseudo-textile fabric; and removing a gap formed on said pseudo-textile fabric using a resin, a film or a sheet.

4 Claims, 8 Drawing Sheets

METHOD OF MANUFACTURING SPEAKER DIAPHRAGM

BACKGROUND OF THE INVENTION

1. Field of the Invention

The present invention relates in general to a method for manufacturing a speaker diaphragm, and more particularly to a method for manufacturing a speaker diaphragm having a pseudo-textile fabric made by arranging carbon yarns or other yarns to come in tangential contact with a plurality of virtual concentric circles so as to eliminate a directional property due to a cross structure of warps and wefts of a prior fabric and to reduce divided vibrations.

2. Description of the Prior Art

In general, a speaker for amplifying and reproducing sounds converts an electrical energy input through a coil to a mechanical vibration energy, and thereby generating sounds. Therefore the shape and the material of a speaker diaphragm are very important factors to decide quality of sounds.

The method for manufacturing a conventional speaker diaphragm using a carbon cloth or an aramid cloth comprises the steps of impregnating a carbon cloth or an aramid cloth with a thermosetting resin and forming a shape of diaphragm from the impregnated cloth. The resultant diaphragm have a rigidity necessary for maintaining the shape of itself since the fibers of the impregnated cloth are bound by a cure of the resin used as a binder.

Forming process is performed by using a mold consisting of an upper part and a lower part. There are voids in the vicinity of intersection points of warps and wefts. The front side or the rear side of the diaphragm is coated with a resin to prevent an air from leaking through the voids.

The conventional speaker diaphragm uses generally a carbon cloth or an aramid cloth having a more higher elastic modulus as it's a material. Because the material is a textile fabric woven by a plain weave method, it is inevitable for the fabric to have a directional property due to the directions of warps and wefts when the fabric is used as the material of the diaphragm.

That is, in the conventional speaker diaphragm, the arrangement directions of yarns(warps and wepts) constituting a textile fabric can not include the all directions of the diaphragm. Therefore according to the arrangement direction of the yarns, the flexural rigidity of the diaphragm, the propagation velocity of a sound and so on become different. This hinders in piston motion of the diaphragm caused by the vibration of a speaker and generates the divided vibrations.

When the divided vibrations are generated from the lower frequency band, sound distortions are generated in higher frequency band as well as in the lower frequency band. As a result, the definition of sound are deteriorated.

In order to avoid the above-mentioned directional property, it is necessary to provide a textile fabric woven in radial. However, it is very difficult to weave the radial fabric.

SUMMARY OF THE INVENTION

Therefore, the present invention has been made in view of the above problem, and it is an objective of the present invention to provide a method for manufacturing a speaker diaphragm having a pseudo-textile fabric made by arranging carbon yarns or other yarns to come in tangential contact with a plurality of virtual concentric circles, thereby eliminating a directional property due to a cross structure of a warps and wefts of a prior textile fabric and reducing divided vibrations.

A method for manufacturing a speaker diaphragm according to the present invention comprising the steps of:

forming a plurality of virtual concentric circles between a central point of a circle having a predetermined size and a circumference thereof;

dividing said each concentric circle with a predetermined angle, marking divided points on the circumference of each concentric circle and arranging a plurality of yarns from point on the circumference of said circle to another point thereof to come in tangential contact with said divided points, thereby forming a pseudo-textile fabric;

thermosetting said pseudo-textile fabric;

stopping up gaps formed on said pseudo-textile fabric using a resin, a film or a sheet.

The yarns used as a material of the pseudo-textile fabric may be natural fibers or synthetic fibers.

The pseudo-textile fabric comprises a thermosetting resin or a thermoplastic resin to form FRP(Fiber Reinforced Plastic) structure.

The speaker diaphragm comprises a composite material made by forming concurrently the pseudo-textile fabric and other material.

BRIEF DESCRIPTION OF THE DRAWINGS

The foregoing and other objects, features, aspects and advantages of the present invention will become more apparent from the following detailed description of the present invention when taken in junction with the accompanying drawings, in which.

DETAILED DESCRIPTION OF THE PREFERRED EMBODIMENTS

Embodiments of the present invention are described below by referring to the accompanying drawings.

The pseudo-textile fabric of the present invention is formed by arranging yarns in radial. The binding force between yarns is very weak because the yarns are not woven by an weaving machine. Therefore the binding force between yarns in the fabric of the present invention is maintained by a binder like as a thermosetting resin or a thermoplastic resin to fix the positions of yarns.

The method for manufacturing a speaker diaphragm according to the present invention comprising a process of forming a pseudo-textile fabric by arranging yarns of a carbon fiber pre-preg(coated with a thermosetting resin), a forming process, a process of the stopping up voids and so on.

The method for manufacturing a speaker diaphragm according to the present invention is described in more detail below.

A. Process of Forming a Pseudo-Textile Fabric

The prior fabric made by a method as like a plain weave is formed by successively intersecting warps and wefts. However the pseudo-textile fabric of the present invention has warp property in a radial direction and a weft property in a concentric direction to obtain an omnidirectional property. In order to complete the fabric, there are steps of comprising a process of forming a plurality of virtual concentric circles between a central point of a circle having a predetermined size and a circumference thereof; a process of dividing said each concentric circle with a predetermined angle, marking divided points on the circumference of said circle, and arranging a plurality of yarns from one point on the circumference of said circle to another point thereof to come in tangential contact with said divided points, thereby forming a pseudo-textile fabric.

Figure 1:
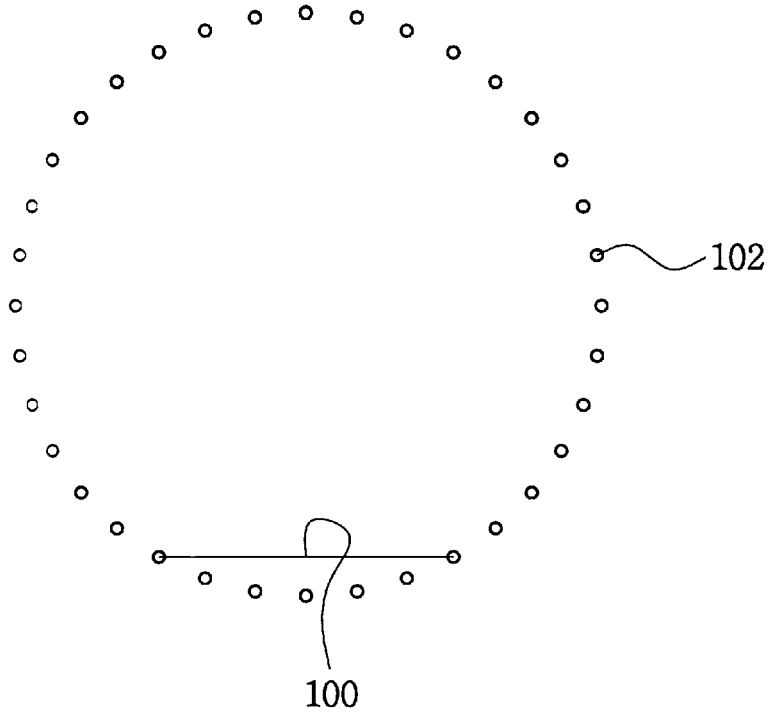
FIG. 1 is a view showing a process for forming first chord of pseudo-textile fabric according to an embodiment of the present invention.

Another method of forming the above-mentioned pseudo-textile fabric according to the present invention as follows;

(1) Referring to FIG. 1, firstly, a circle having a predetermined size is formed. Thereafter a plurality of divided points 102 are marked on the circumference of the circle (for example, when the circle is divided with an angle of 5 degrees, total 72 divided points 102 are marked on the circumference of the circle). One end of an yarn is fixed on the one divided point on the circumference. The other end of the yarn is connected to another divided point to form a first arc and a first chord 100 having a predetermined size.

Figure 2:
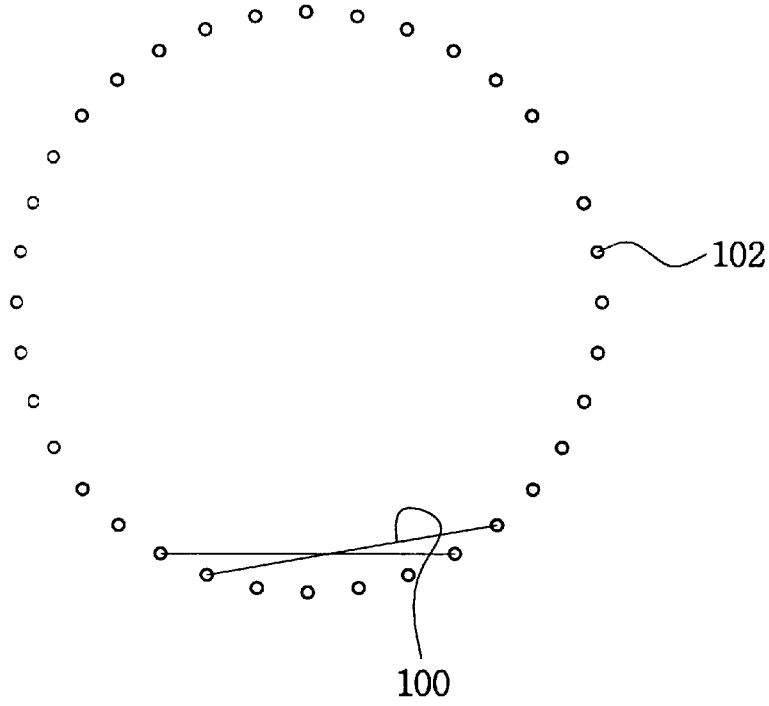
FIG. 2 is a view showing a process for forming second chord of pseudo-textile fabric according to an embodiment of the present invention.

(2) Referring to FIG. 2, one end of an another yarn is fixed on an another divided point placed at a predetermined distance from the first divided point. And the other end of the another yarn is connected to an further another divided point to form the arc and chord. At this time, the size of the first arc is the same as that of the second arc, and the size of the first chord is the same as that of the second chord.

Figure 3:
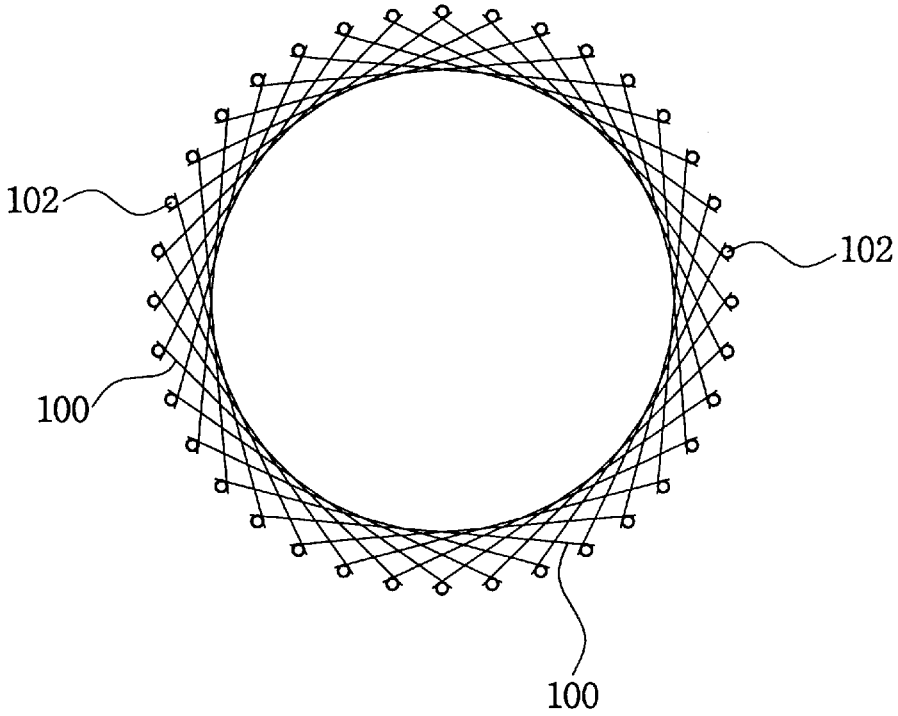
FIG. 3 is a view showing the shape of the outmost concentric circle formed by a cross arrangement of yarns.

(3) Referring to FIG. 3, when a plurality of intersecting chords 100 are formed by procedures (1) and (2), the shape formed by intersecting chords is a polygon. The number of sides of the polygon is the same as that of chords. The more the divided angle is small, the more the shape looks like a circle. In this case, it is appreciated that each chord comes in tangential contact with the circle.

The divided angle and the number of chords may be determined according to the density of a desired pseudo-textile fabric because they are related to the density of the fabric to be made.

Figure 4:
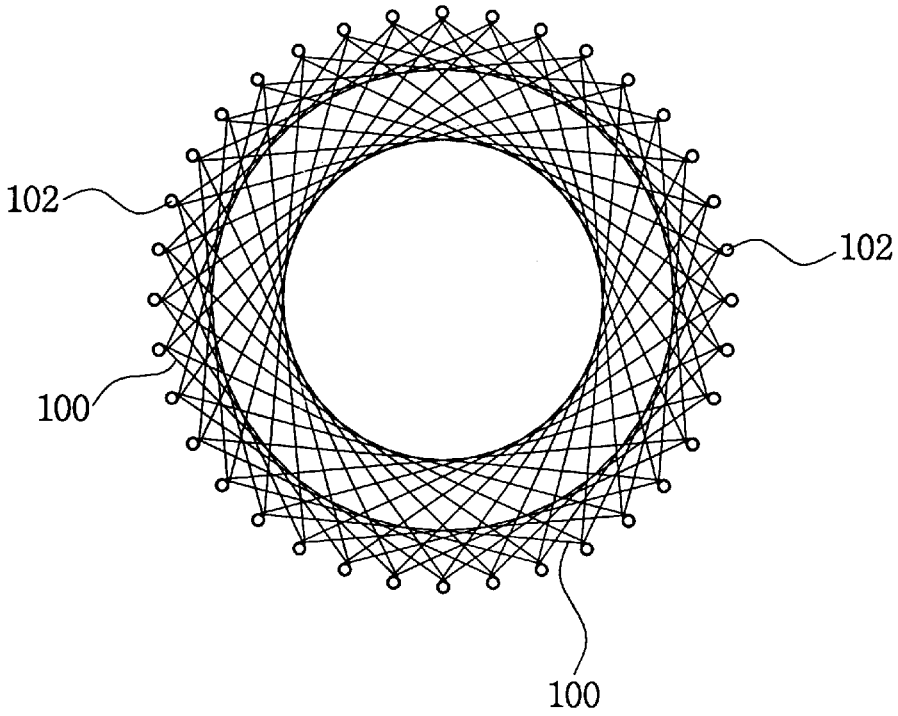
FIG. 4 is a view showing the shape of the inner concentric circle formed by cross arrangement of yarns.

(4) Referring to FIG. 4, when the shape of first circle is completed by a first group of intersecting chords, another arc and chord which are different from the first arc and chord are formed by above procedures (1) and (2). Thereafter the shape of second circle is formed by a second group of intersecting chords formed by procedures (3).

Circles formed thus are a concentric circle. The number of the concentric circle may be adjusted by the divided angle. Therefore the desired number of circles of the concentric circle can be obtained by adjusting the divided angle according to the density of the pseudo-textile fabric to be made.

Figure 5:
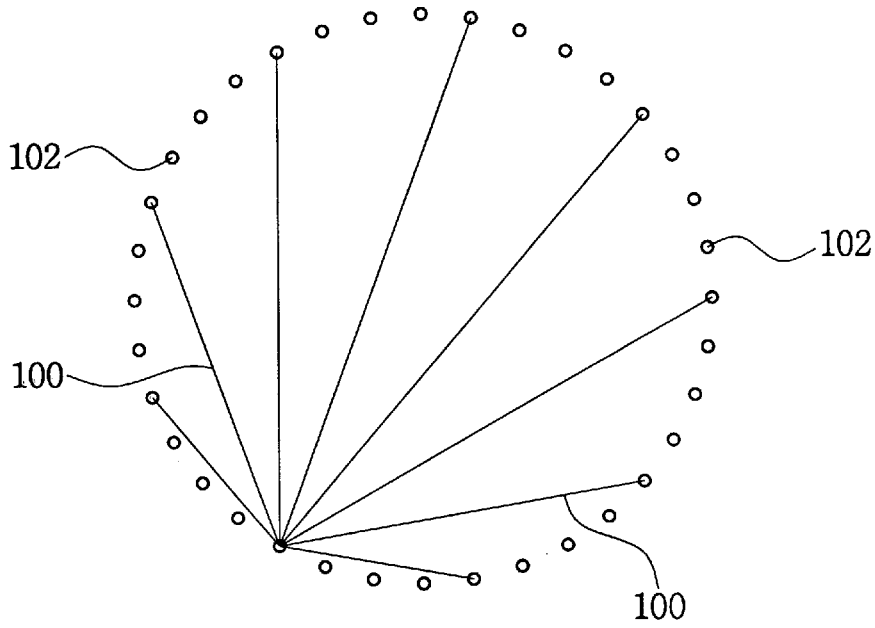
FIG. 5 and FIG. 6 are views showing a process forming chords of a pseudo-textile fabric according to an another embodiment of the present invention.
Figure 6:
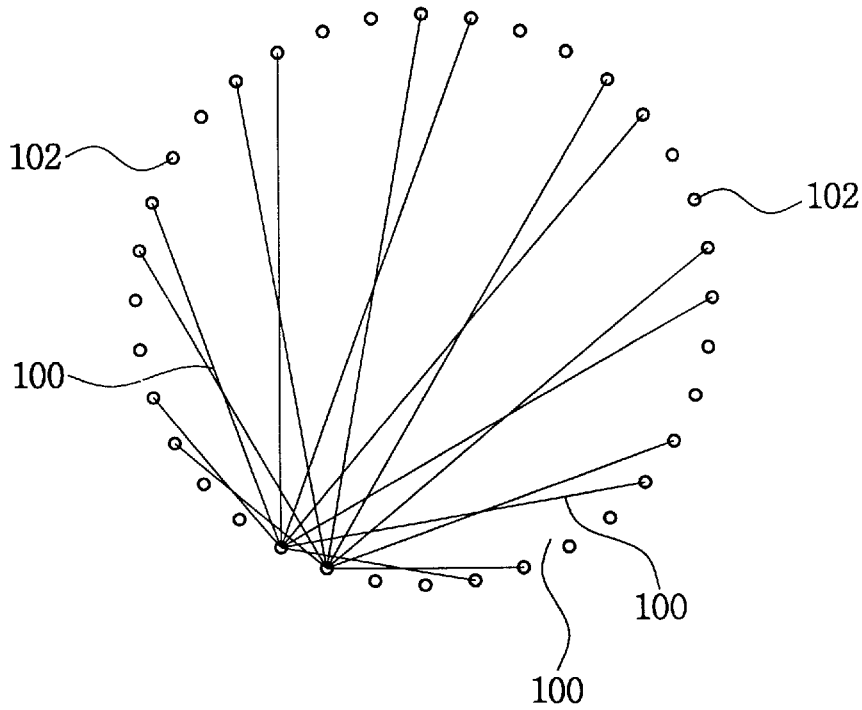

(5) Referring to FIG. 5 and FIG. 6, circles of the concentric circle may be formed by enlarging the diameter of the circle form the outside to the inside or diminishing the diameter of the circle from the inside to the outside. As an another method of forming a concentric circle is described below.

Firstly, a first group of chords are formed by connecting yarns 100 between one divided point and other divided points respectively. And thereafter, a second group of chord are formed by connecting yarns between another divided point placed at a predetermined distance from the one divided point and the other divided points.

Figure 10:
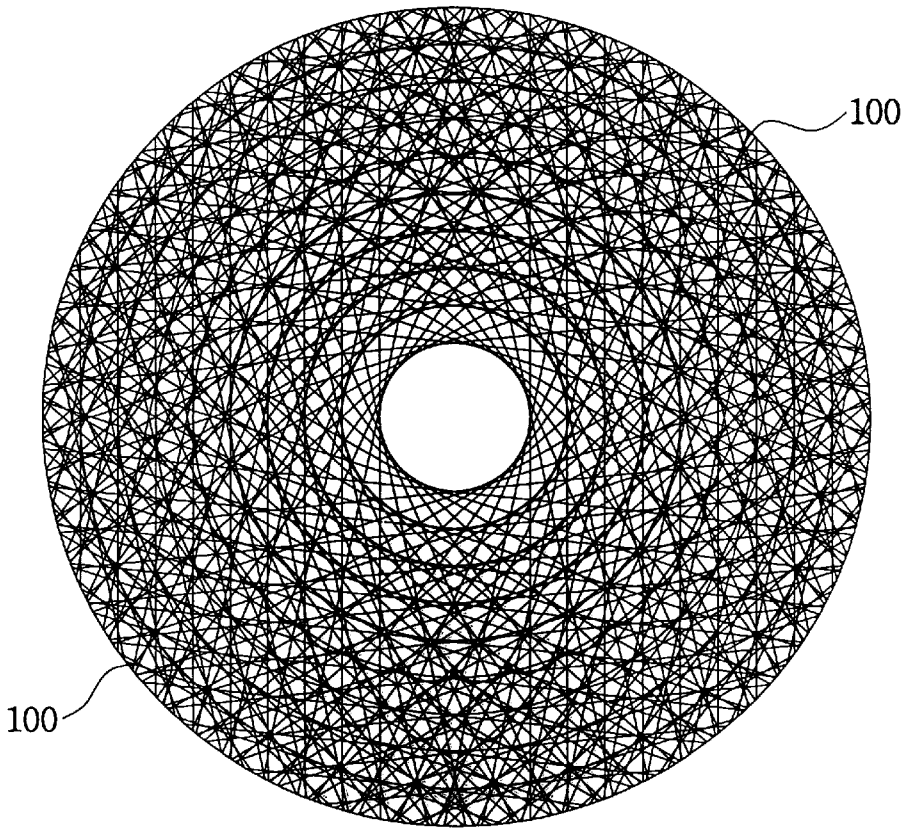
FIG. 10 is a view showing a completed shape of a pseudo-textile fabric formed according to an embodiment of the present invention.

The method of forming the concentric circle may be determined according to the appearance and the manufacturing method of a desired fabric. As a result, even though the sequence for connecting between yarns is different, the obtained resultant fabrics are always a pseudo-textile fabric having a omnidirectional property as shown FIG. 10.

In the case of the prior fabric, each yarn is distinctly identified as an warp or an wept in accordance with a direction to be woven. However, in the case of the pseudo-textile fabric according to the present invention, each yarn can have a property as an warp and a property as an wept in accordance with it's relative position. This is described in more detail below. In the present invention, the yarn connected from one divided point through a central point to the other divided point opposite to the one divided point is an warp, while the other yarns come in tangential contacted with theirs concentric circles are wefts in the vicinity of theirs tangent points, and are warps at points intersected with the other concentric circles. Also, the tangent lines (yarns) are intersected with the other concentric circles. The more the tangent lines away from the other concentric circles, the more they have a property as the warp. Also, the tangent lines are intersected with the lines (yarns) which go through in opposition direction when they go through between concentric circles. In this case they have a property opposite to the property of the intersected line.

As above described, the yarn of the pseudo-textile fabric according to the present invention has both the property as the warp and the property as the weft. That is, the yarn has not the predetermined property. The yarn has a relative property in accordance with the position of relation with the concentric circles and the other yarns.

Therefore, in order to set warp property or wept property in design step of the pseudo-textile fabric as described above, it is desired that a jig having a shape like as that of a diaphragm is used. In order to prepare the diaphragm, the method of using the jig is described below.

Figure 7A:
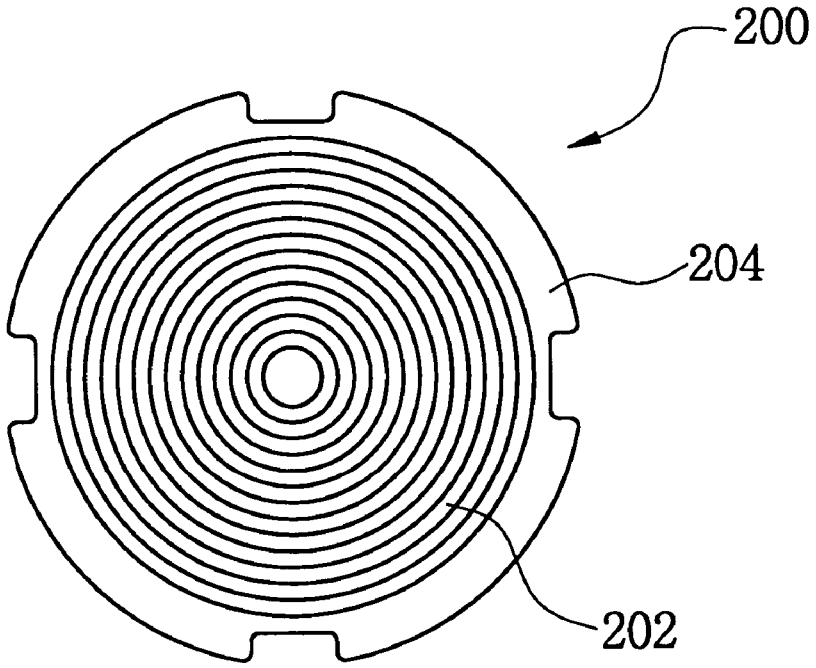
FIG. 7A is a top view showing the jig used in forming a pseudo-textile fabric according to the present invention.
Figure 7B:
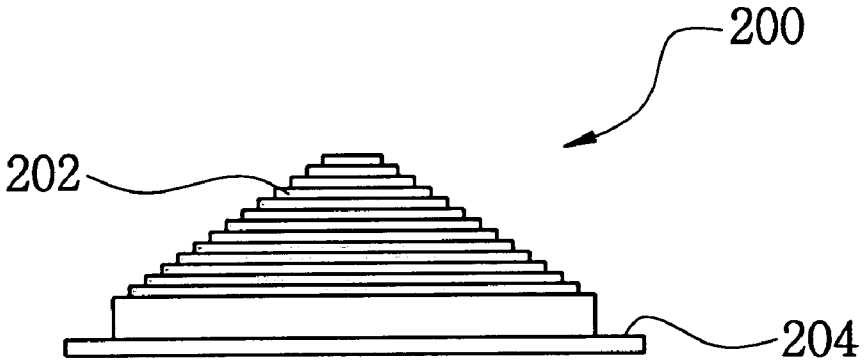
FIG. 7B is a side view showing the jig used in forming a pseudo-textile fabric according to the present invention.

① The surface of the jig having the shape like as that of a diaphragm is formed in step shape as shown in FIG. 7A and FIG. 7B. At this time, a step 202 has a width of about 5 mm and a rectangular shape.

Figure 8A:
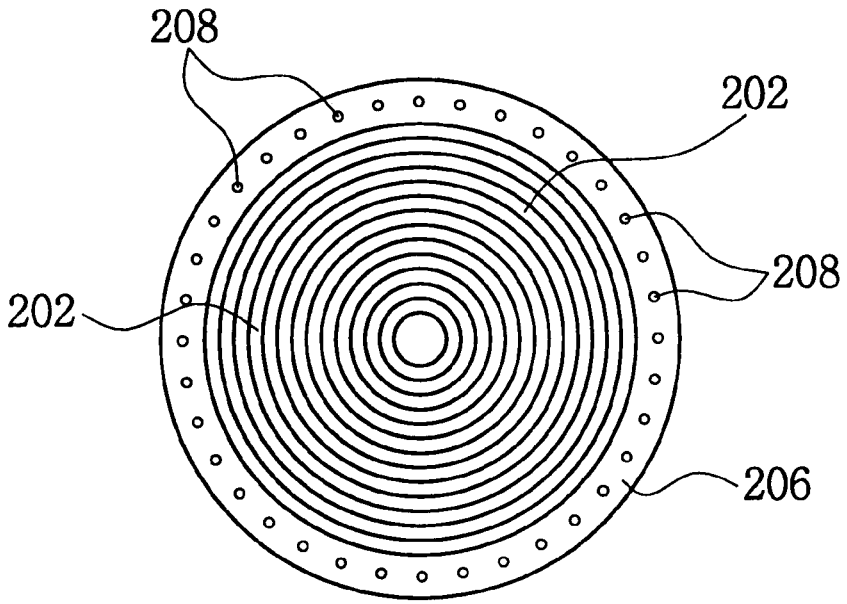
FIG. 8A is a top view showing a coupling state of the jig and a ring used in fixing yarns thereon in the case of using the jig according to a further embodiment of the present invention.
Figure 8B:
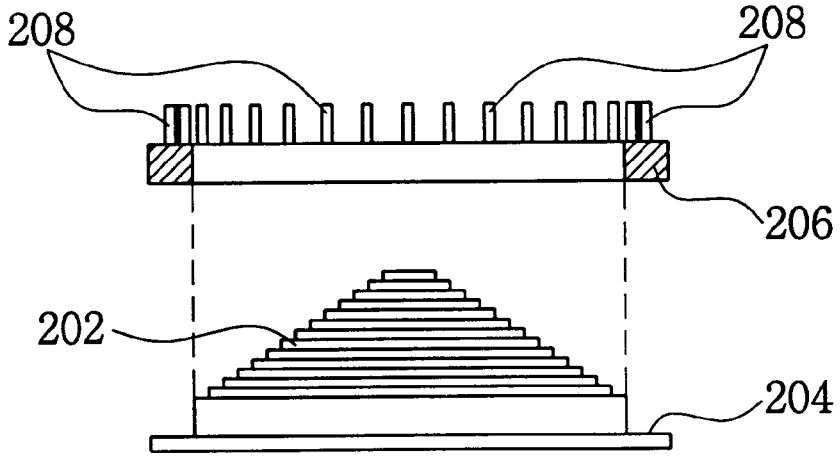
FIG. 8B is a side view showing a coupling state of the jig and a ring used in fixing yarns thereon in the case of using the jig according to the further embodiment of the present invention.

② A removable ring 204 is attached to the outer of the jig. The circumference of the ring is divided with an angle of about 5 degrees. All 72 pins 208 are set on the divided points as shown in as FIG. 8A and FIG. 8B. Pins have functions fixing yarns in the predetermined position, also enabling the ring to be removed from the jig without dispersing a shape of the fabric.

Figure 9:
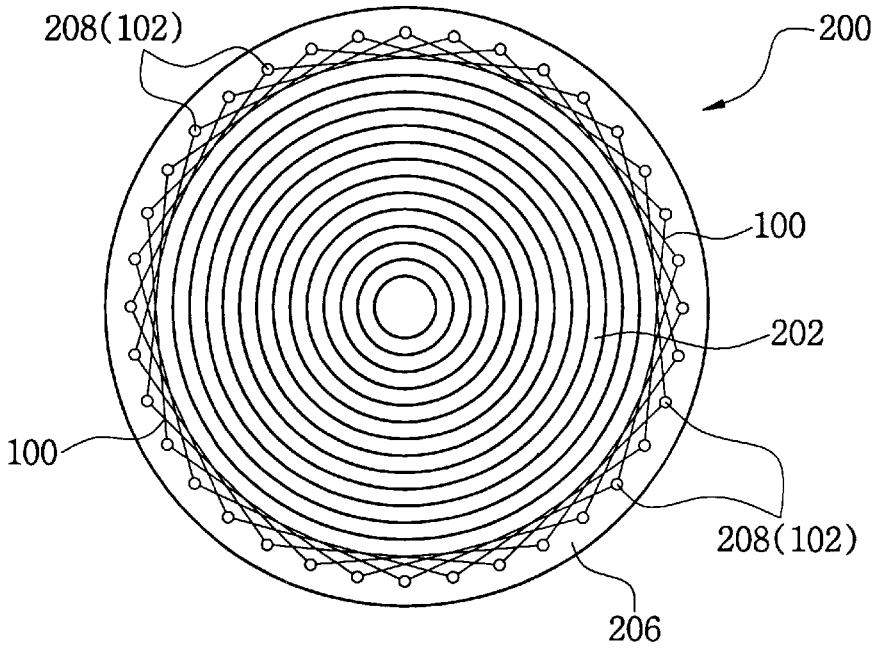
FIG. 9 is a view showing the cross arrangement and fix statement of yarns in the case of using the jig according to a further embodiment of the present invention.

③ At one divided point of the most outer step, a yarn is arranged so as to come in tangential contact with the circle formed on the inner step. A plurality of yarns are successively arranged according to the above-mentioned method as shown in FIG. 9.

④ When the arrangement of yarns at the most outer step is completed, the next arrangement of yarns at the inner step is started according to the above-mentioned method. As a result, the resultant pseudo-textile fabric can be obtained.

B. Forming Process

After the pseudo-textile fabric is obtained, the fabric is heated with a predetermined heat to maintain it's shape and intensity. In the preferred embodiment of the present invention, the yarn used as raw material of the pseudo-textile fabric is a carbon fiber pre-preg. The carbon fiber pre-preg may be formed by only heat required for a cure since it contains a thermosetting resin. The resin used as a binder for the carbon fiber pre-preg includes a thermosetting resin (epoxy resin, ester resin and so on) and a thermoplastic resin(polypropylene resin, polyethylene resin, acryl resin and so on). It may be properly selected from the above-described resins according to the object of the use.

C. Process of Stopping up Voids

On the surface of the pseudo-textile fabric are formed many voids like as the prior fabric. It is very difficult to completely eliminate voids though the number and the size of the voids can be adjusted by the density of the pseudo-textile fabric or the arrangement of yarns. Therefore, an additional process as below is necessary for stopping up the voids.

① Example using a resin coating

The resin is applied to the front surface or rear surface of the pseudo-textile fabric. The resultant fabric is dried by a dryer to stop up the voids.

② Example using a film or a sheet

Before or after forming the pseudo-textile fabric, a film or a sheet is applied to it so as to stop up the voids. The coating materials include pulps, plastic films, metal films and so on. Both the front surface and rear surface of the pseudo-textile fabric may be used as an applying surface.

D. Process of Cutting a Redundant Part

Figure 11:
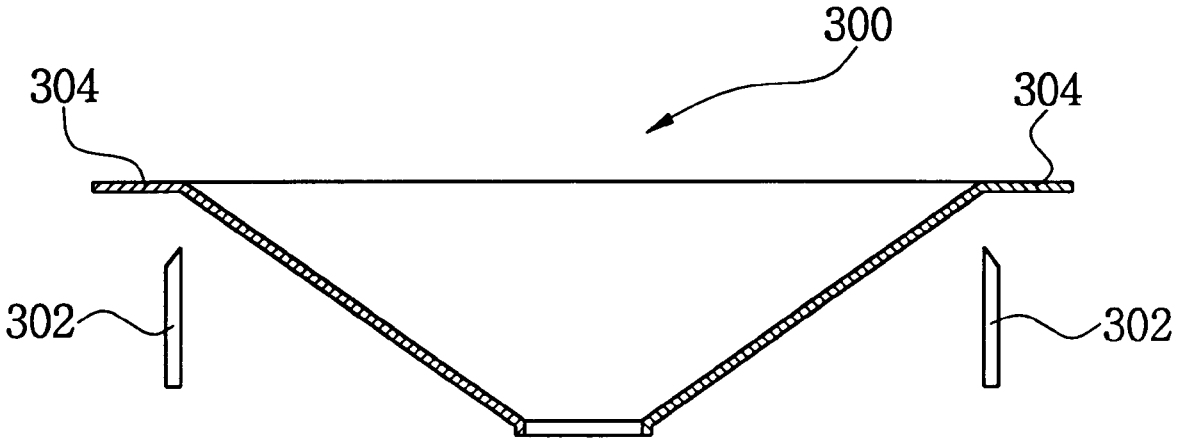
FIG. 11 is a view showing a schematic sectional structure of a diaphragm made by the pseudo-textile fabric as shown in FIG. 10.
Figure 12:
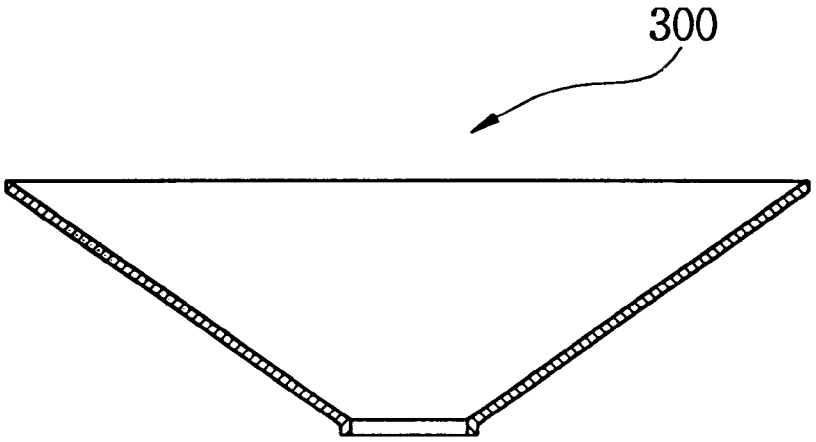
FIG. 12 is a view showing a schematic sectional structure of a diaphragm body made by cutting through a margin of the diaphragm as shown in FIG. 11.

In order to form a body of the diaphragm, the redundant part 304 of a formed pseudo-textile fabric is removed by a cutter 302 as shown in FIG. 11 and FIG. 12.

E. Process of Bonding Edges to the Body

Figure 13:
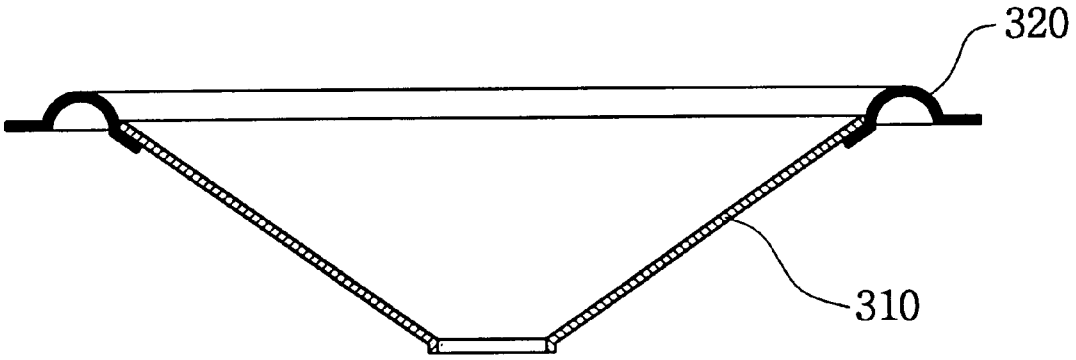
FIG. 13 is a view showing a schematic sectional structure of a shape of the diaphragm completed by bonding edges to the diaphragm body as shown in FIG. 12.
Figure 14:
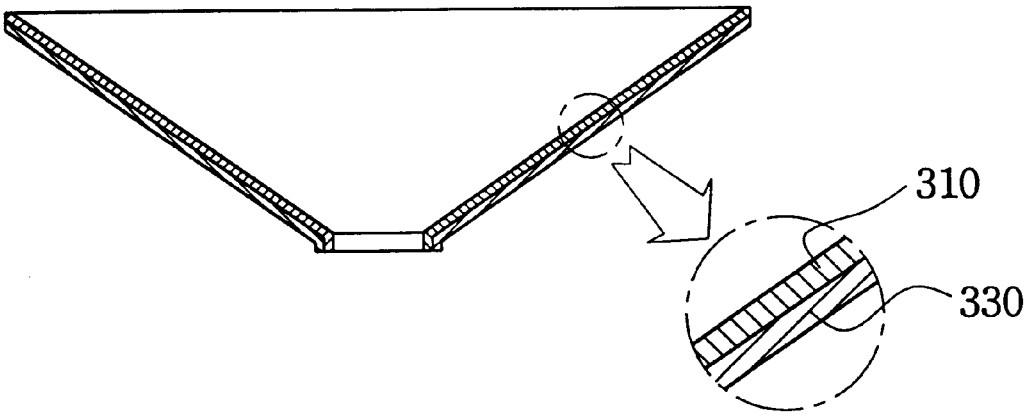
FIG. 14 is a view showing a schematic sectional structure of the diaphragm formed by bonding other material to the diaphragm as shown in FIG. 12.

Lastly, edges 320 are bonding to the diaphragm body 310 to complete a diaphragm as shown in FIG. 13.

As describe above, in the preferred embodiment of the present invention, a carbon fiber pre-preg(coated with a thermosetting resin) is used as a yarn in order to form a pseudo-textile fabric. However a kind of yarn is not restricted to the above case. For example, it is possible to use yarns as below;

① Aramid fibers or aramid pre-pregs (coated with the thermosetting resin)

② Chemical fibers including a carbon fiber, an acryl, a polyester, a nylon and so on ③ Blending fibers mixing a carbon with an aramid or the other fibers ④ Natural fibers including a silk and so on As described above, since the speaker diaphragm according to the present invention has a pseudo-textile fabric made by intersecting a plurality of yarns to come in tangential contact with virtual concentric circles, it offers several advantages not afforded the speaker diaphragm. That is, the speaker diaphragm manufactured according to the present invention eliminates a directional property due to a cross structure of warps and wefts of a prior fabric and reduces the divided vibrations generated in vibration of the diaphragm. As a result, it is possible to reduce the distortion of sounds and achieve a high definition of sound.

Moreover, in the prior art case that a high elastic fiber is used as yarns, it is inevitable that the fabric woven by the yarns has a directional property due to a cross structure of warps and wefts even though high definition of sound is achieved by a high elasticity and an internal loss of itself. Because of the directional property, the speaker diaphragm of the prior art has not an uniformity as a medium propagating a force applied to a central part of the diaphragm to a peripheral circumference. A flexural rigidity from a central part to a peripheral circumference of the diaphragm, a propagation velocity of sound, elastic modulus and an internal loss in the diaphragm are very different according to directions.

Also, in the prior art diaphragm, the flexural rigidity generated in symmetric direction is different according to directions. This bring the divided vibrations to the diaphragm. However, in the present invention, since the directional property is removed, it is possible to remarkably reduce the divided vibrations.

Furthermore, the method for manufacturing the pseudo-textile fabric according to the present invention may be adjusted by changing the component ratio between warps and wefts. As a result, it is possible to improves sound quality and a physical property by adjusting the component ratio.

Although the present invention has been described and illustrated in detail, it is clearly understood that the same is by way of illustration and example only and is not to be taken by way of limitation, the spirit and scope of the present invention bing limited only by the terms of the appended claims.

We claim:

1. A method for manufacturing a speaker diaphragm comprising the steps of:

forming a plurality of virtual concentric circles between a central point of a circle having a predetermined size and a circumference thereof;

dividing said each concentric circle with a predetermined angle, marking divided points on the circumference of each concentric circle and arranging a plurality of yarns from a point on the circumference of said circle to another point thereof to come in tangential contact with said divided points, thereby forming a pseudo-textile fabric;

thermosetting said pseudo-textile fabric; and stopping up gaps formed on said pseudo-textile fabric using a resin, a film or a sheet.

2. The method as claimed in claim 1, wherein the yarns used as a material of the pseudo-textile fabric include natural fibers or synthetic fibers.

3. The method as claimed in claim 1, wherein the pseudo-textile fabric comprises a thermosetting resin or a thermoplastic resin so as to form FRP(Fiber Reinforced Plastic) structure.

4. The method as claimed in claim 1, wherein the speaker diaphragm comprises a composite material made by forming concurrently the pseudo-textile fabric.

* * * * *